US005711623A

United States Patent [19]

Nose

[11] Patent Number: 5,711,623

[45] Date of Patent: Jan. 27, 1998

[54] INK RIBBON RECORDING APPARATUS

[75] Inventor: Yoshitaka Nose, Kyoto, Japan

[73] Assignee: Murata Kikai Kabushiki Kaisha, Kyoto, Japan

[21] Appl. No.: 381,011

[22] Filed: Jan. 30, 1995

Related U.S. Application Data

[63] Continuation of Ser. No. 977,550, Nov. 17, 1992, abandoned.

[30] Foreign Application Priority Data

Nov. 30, 1991 [JP] Japan ..... 3-342242

[51] Int. Cl.[6] ..... B41J 33/14

[52] U.S. Cl. ..... 400/225; 400/219

[58] Field of Search ..... 400/219, 225, 400/227.2, 249, 207, 120.01

[56] References Cited

U.S. PATENT DOCUMENTS

| | | | |
|---|---|---|---|
| 4,611,938 | 9/1986 | Rettke | 400/227.2 |
| 5,092,695 | 3/1992 | Silverman | 400/249 |

FOREIGN PATENT DOCUMENTS

| | | | |
|---|---|---|---|
| 226578 | 12/1984 | Japan | 400/120 |
| 258783 | 11/1986 | Japan | 400/225 |
| 25343 | 1/1990 | Japan | 400/225 |
| 169266 | 6/1990 | Japan | 400/120 |
| 61553 | 3/1991 | Japan | 400/120.1 |

*Primary Examiner*—Edgar S. Burr
*Assistant Examiner*—Steven S. Kelley
*Attorney, Agent, or Firm*—Loeb & Loeb LLP

[57] ABSTRACT

A single-pass ink ribbon and a multi-pass ink ribbon are incorporated in a single recording apparatus. An identification mark is attached to one end of the single-pass ribbon (or the multi-pass ink ribbon) so that a ribbon sensor can discriminate two kinds of ribbon from each other to find out which one is used for the printing. With the result of the discrimination, a controller selects an appropriate program to set up a printing condition for the ribbon being used for the printing. A thermal head temperature, a degree of wear of the ribbon and a black ratio of the ribbon may also be taken in account in determining the printing condition. If the thermal head temperature is used, one temperature table is selected from a number of temperature tables which are prepared in advance for respective temperature. The printing condition is determined such that the printing density is maintained as long as the same ink ribbon is used. If the multi-pass ink ribbon is used for the printing, the ink ribbon is pulled back to a position from which the first printing starts, upon the completion of the printing operation.

12 Claims, 10 Drawing Sheets

INK RIBBON RECORDING APPARATUS

This is a continuation of application Ser. No. 07/977,550 filed on Nov. 17, 1992, now abandoned.

BACKGROUND OF THE INVENTION

1. Technical Field

The present invention relates to a recording apparatus using both a single-pass ink ribbon and a multi-pass ink ribbon and also a recording apparatus using a multi-pass ink ribbon only.

2. Background Art

Various ink ribbon recording apparatuses were developed. However, conventional recording apparatuses have several shortcomings. One of the shortcomings of a thermal transfer type ink ribbon recording apparatus is that when a widely prevailed single-pass ink ribbon is used, the use of single-pass ink ribbon results in a high running cost of the recording apparatus. This is because the ink ribbon is thrown into a trash can after a single time of thermal transfer recording.

Therefore, a multi-pass ink ribbon is developed. With the multi-pass ink ribbon, it is possible to use the same surface of the ribbon several times. However, the recording apparatus should allow an operator to selectively use the single-pass ink ribbon and the multi-pass ink ribbon since one may prefer the single-pass ink ribbon but another may prefer the multi-pass ink ribbon. Further, since the operator should choose the single-pass ink ribbon (or multi-pass ink ribbon) under a certain circumstance regardless of his preference, the recording apparatus must be provided with a selection device. If the recording apparatus is equipped with both the single and multi-pass ink ribbons, then appropriate printing conditions for the respective ribbons should be automatically set up by a certain device. Conditions for ribbon movement should be also automatically set up if two different ribbons are incorporated into a single recording apparatus.

Even if the recording apparatus is equipped with a multi-pass ink ribbon only, some problems arise. As a nature of the multi-pass ink ribbon, the printing density varies as the printing proceeds. Therefore, if conditions for the thermal transfer printing are fixed, uniform printing density cannot be expected. In addition, the printing quality drops after the first printing. One reason of these problems is that the printing density changes as the printing operation is repeated even if the conditions for the thermal transfer printing are constant. Another reason is that an "accumulated black ratio" of the ribbon surface ("black" means being used for the printing and the black ratio is accumulated every printing.) affects the next printing density. In other words, part of the ribbon which is not used for the printing stays "white" and that used for the printing becomes "black", and the black is added up. Consequently, every part of the ribbon surface has a different accumulated black ratio.

Generally, the multi-pass ink ribbon is passed through a thermal head several times. In this case, the ribbon is unrolled from a first package (sending package) and rolled around a second package (receiving package) during a first printing, and then before the second printing, the second package should be moved to a position of the first package so that the second package serves as a sending package and the first package should be also moved to the position of the second package to change its role. Thus, a troublesome handling by an operator is required after every printing. Further, in order to grasp the wear of the ink ribbon, a certain operator should always pay an attention to how many times the packages are reversed. In other words, a visual monitoring is required to know the wear of the ribbon.

SUMMARY OF THE INVENTION

The present invention is developed to eliminate the above-mentioned problems and its primary object (first object) is to provide a recording apparatus which can automatically discriminate a single-pass ink ribbon and a multi-pass ink ribbon from each other so that an operator can selectively use these two ribbons in a single recording apparatus.

Another object (second object) of the present invention is to provide a recording apparatus which can automatically set up printing conditions and ribbon movement conditions for a single-pass ink ribbon and a multi-pass ink ribbon respectively.

Still another object (third object) of the present invention is to provide a recording apparatus which can automatically change conditions for thermal transfer printing in accordance with a degree of wear of the ribbon surface. The degree of "wear" corresponds to how many times the ribbon is used or the frequency in use of the ribbon surface for the printing.

Yet another object (fourth object) of the present invention is to provide a recording apparatus which can automatically change, after the first printing operation, the conditions for the thermal transfer printing in accordance with accumulated black ratios of the ribbon surface.

Still another object (fifth object) of the present invention is to provide a recording apparatus which can exclude the necessity of troublesome handling and can exclude the necessity of visual monitoring of how many times the ribbon is used.

To achieve the first object (or according to the first aspect of the present invention), there is provided a recording apparatus which has ribbon discrimination means. An identification element is attached to or formed in at least one of the ribbons so that the ribbon discrimination means can discriminate two kinds of ribbons from each other to find out which one is used for the printing.

To achieve the second object (or according to the second aspect of the present invention), there is provided a recording apparatus which has ribbon discrimination means and condition control means. Like the preceding paragraph, an identification mark is attached to or formed in at least one of the ribbons so that the ribbon discrimination means can discriminate the two ribbons to find out which one is used for the printing. With the result of the discrimination, the control means automatically sets up the printing conditions and the ribbon movement conditions for the ribbon used for the printing.

To achieve the third object (or according to the third aspect of the present invention), there is provided a recording apparatus which has print control means. The print control means determines the printing operation of the thermal head in accordance with a temperature table. A single temperature table is selected among a number of temperature tables by the print control means in accordance with the frequency in use of the particular ribbon surface for the printing. This aspect is applied to the recording apparatus using a multi-pass ink ribbon.

To achieve the fourth object (or according to the fourth aspect of the present invention), there is provided a recording apparatus which has another print control means. This print control means adds up the black ratio of the ribbon surface and selects the temperature table using the added up black ratio. A first black ratio is obtained after the first printing so that the first selection of the temperature table is carried out before the second printing. This aspect is also applied to the recording apparatus using a multi-pass ink ribbon.

To achieve the fifth object (or according to the fifth aspect of the present invention), there is provided a recording apparatus which has means for controlling the ribbon movement. Specifically, the ribbon movement control means pulls back the ribbon to the start position of the first printing upon the completion of every printing operation. This pulling back operation is performed at least once. Practically, the number of the pulling back operations is (the permissible time of the passes (or printings) of the ink ribbon through the thermal head)—1. This aspect is also applied to the recording apparatus using a multi-pass ink ribbon.

According to the first aspect of the present invention, when either one of the single-pass ink ribbon or the multi-pass ink ribbon is set, the ribbon discrimination means detects the kind of the ribbon using the identification mark attached to or formed in the ribbon. Accordingly, the recording apparatus can automatically judge which ribbon is set. With this function, it is practically possible to use two kinds of ribbon in a single recording apparatus.

According to the second aspect of the present invention, the second control means automatically controls the printing conditions and the movement conditions of the respective ink ribbons. These conditions vary with the kind of the ribbon, which is detected by the aforementioned ribbon discrimination means.

According to the third aspect of the present invention, the conditions of the thermal transfer onto a particular surface of the ribbon are determined using a corresponding temperature table. A single corresponding temperature table is selected among a number of temperature tables in view of the number of the printings on the particular surface of the ribbon. As a result, the printing density is maintained constant.

According to the fourth aspect of the present invention, the black ratio of a particular ink ribbon surface is added up to obtain an accumulated black ratio. With this accumulated black ratio being a parameter, the most appropriate temperature table to be used in determining the conditions of the printing from the thermal head onto the particular ribbon surface is selected. Therefore, even if the accumulated black ratios vary with the positions of the ribbon (or segments of the ribbon), the printing density is maintained constant. In addition, the longevity of the ink ribbon is extended since almost all the ribbon surface can be used for the printing.

According to the fifth aspect of the present invention, when the first printing operation is completed, the second printing operation (and the following printing operations) starts from the same starting position as the first printing operation. Therefore, the same area (first area) of the ribbon is used for the printing in the first and second printing operations. This is repeated up to the permissible printing times of the ink ribbon. Then, the second area of the ribbon, which for example extends next to the first area, is used for the printing. This is also repeated up to the permissible printing times of the ink ribbon. After that, the non-used neighboring areas are used in turn for the printing the predetermined times, respectively. When the ink ribbon is completely wound into the rolling package, it is found that substantially all the areas of the ink ribbon have been used for the printing.

These and other aspects, objects and advantages of the present invention will become more apparent from a following detailed description as read with the accompanying drawings and appended claims.

DESCRIPTION OF THE PREFERRED EMBODIMENTS

Now, preferred embodiments of the present invention will be described in reference to the accompanying drawings.

Figure 5:
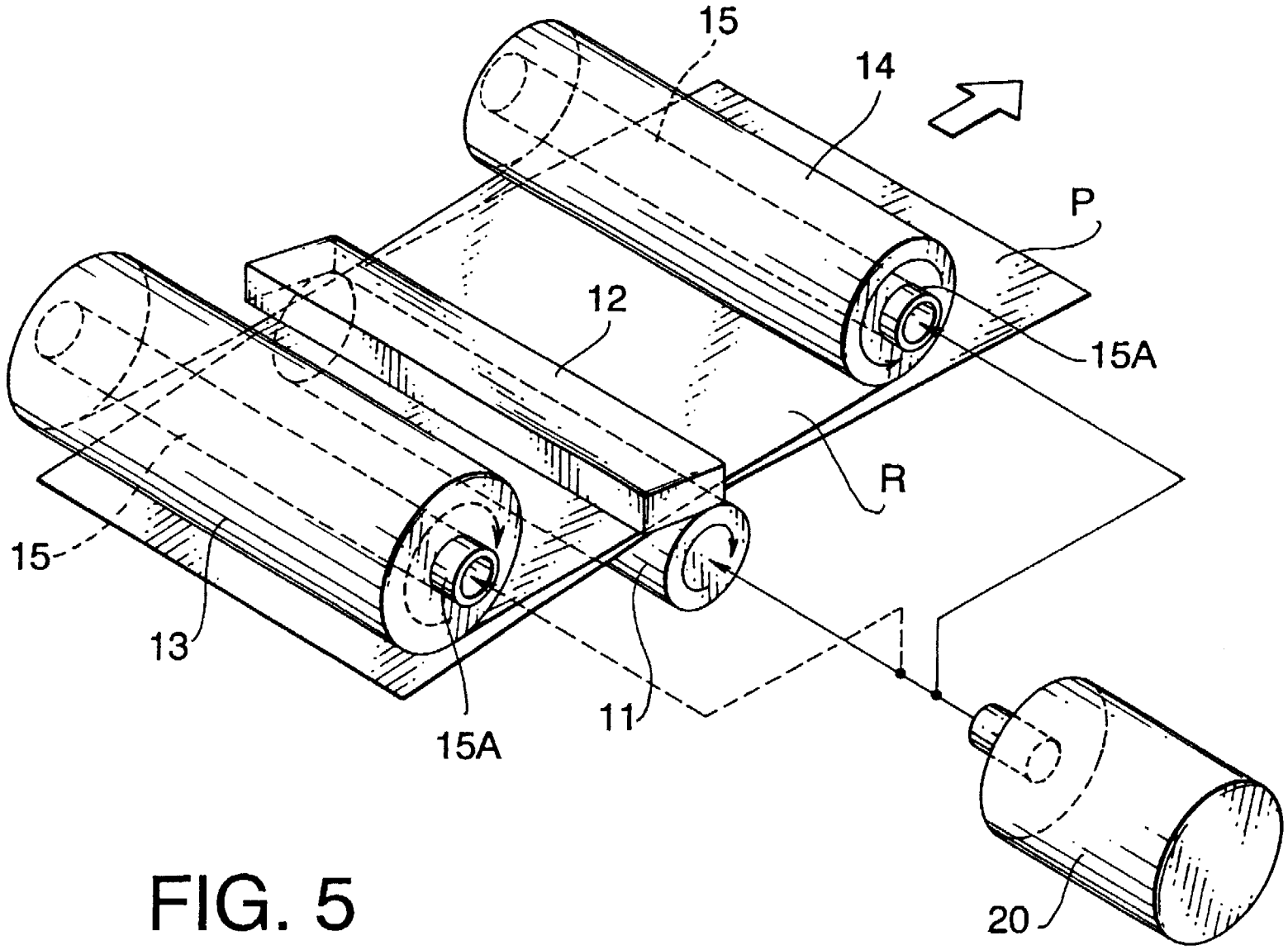
FIG. 5 is a perspective view of major components of the ink ribbon recording apparatus of FIG. 1.

First, a general idea of an ink ribbon recording apparatus to which the present invention is directed will be explained. As one example, FIG. 5 of the accompany drawings depicts a major part of a thermal transfer recording apparatus incorporated in a facsimile machine. As illustrated, an ink ribbon R unrolled from a ribbon package 13 and a recording sheet (common paper) P overlying the ink ribbon R extend between a platen roller 11 and a thermal head (T/H) 12 forcibly pressed against the platen roller 11. The ink ribbon R and the recording sheet P move in the direction as indicated by the non-shaded arrow. The ink of the ribbon R is thermally transferred on the recording sheet P by the thermal head 12 and then the ink ribbon R leaves the recording sheet P to be rolled into a rolling package 14.

The ribbon package 13 and the rolling package 14 have paper tubes 15 as their center pieces, respectively. The ribbon package and the center piece may be referred to as an ink ribbon unit. Both ends of each paper tube 15 are connected to rotatable shafts (not shown) when the paper tube 15 is installed in the recording apparatus. The recording apparatus includes a step motor 20 which is a mutual drive source with the platen roller 11, the rolling package 14 and the ribbon package 13. When the recording paper P and the ink ribbon R are unrolled for the printing, the platen roller 11 and the rolling package 14 are rotated in a normal direction (counterclockwise direction, as indicated by the solid line arrow). On the other hand, during the pulling back operation of the ink ribbon R, the ribbon package 13 is rotated in the opposite direction (as indicated by the broken line arrow). Both a single-pass ink ribbon and a multi-pass ink ribbon are incorporated in this recording apparatus and one of them is used as the ink ribbon R. The single-pass ink ribbon is an ink ribbon which is thrown away after one printing operation and the multi-pass ink ribbon is an ink ribbon which can be repeatedly used for the printing operation. The same face of the ink multi-pass ribbon is used a predetermined time. The only difference between these ink ribbons is the ink application (The ribbon structure and the associated components are substantially the same.).

Figure 6:
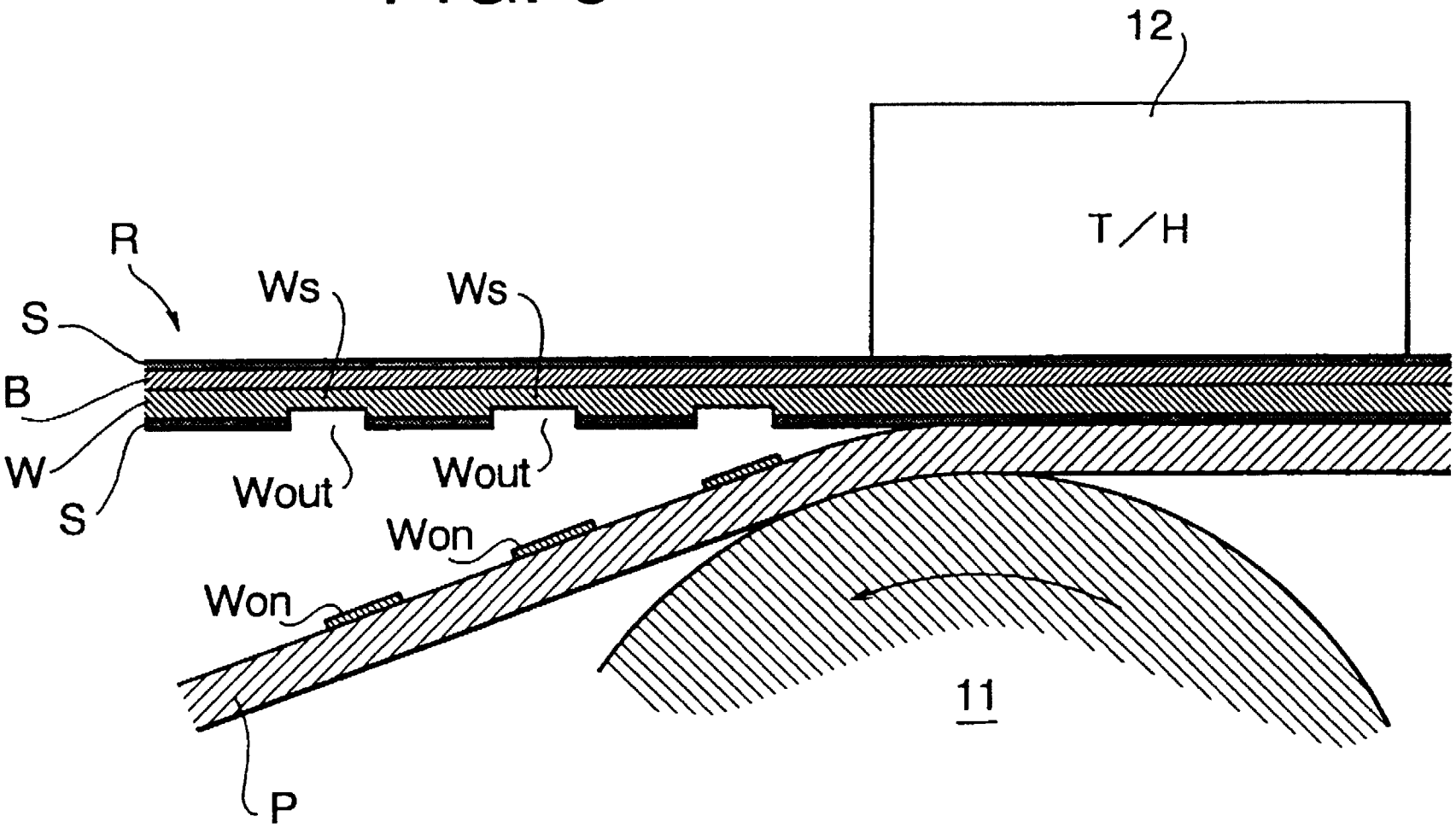
FIG. 6 is a sectional view showing the first printing operation with a multi-pass ink ribbon.

Referring now to FIG. 6, illustrated is an example of the printing when the multi-pass ink ribbon is employed. The multi-pass ink ribbon includes a base B, a thick ink (wax) W applied on a transfer surface of the base B, and two heat resisting layers S's laid over the base B and the ink W, respectively. During the first printing, as illustrated in FIG. 6, the ink Won is thermally transferred on the recording sheet P in accordance with a thermal image of the thermal head 12. An after-the-thermal-transfer recess Wout of the ink ribbon R, which has lost the heat resisting layer S, has an ink layer Ws exposed. The next printing is enabled by the ink layer Ws. However, it should be noted that since the recess portion Wout does not have the surface layer S, the printing density will change at the second printing even if the printing condition is the same as the first printing. Generally, the second printing is darker than the first printing.

In order to allow an operator to selectively use an ordinary single-pass ink ribbon and an ordinary multi-pass ink ribbon in the recording apparatus of the present invention, a discrimination mark is given to at least one of the ink ribbons. Further, the recording apparatus is provided with means for identifying the ribbon discrimination mark.

Figure 1:
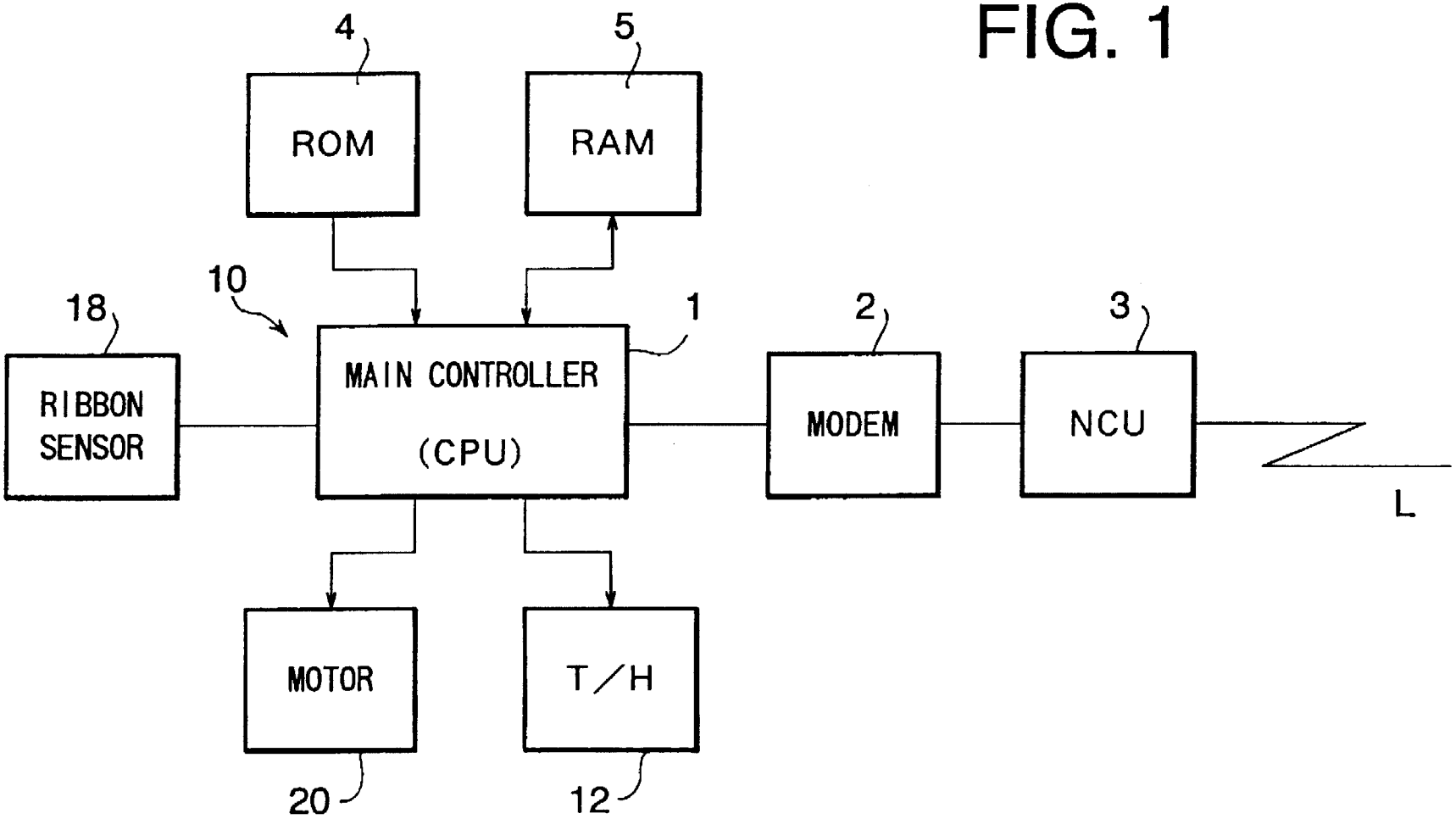
FIG. 1 is a block diagram of a controller incorporated in a facsimile machine showing an embodiment of an ink ribbon recording apparatus according to the present invention.
Figure 7:
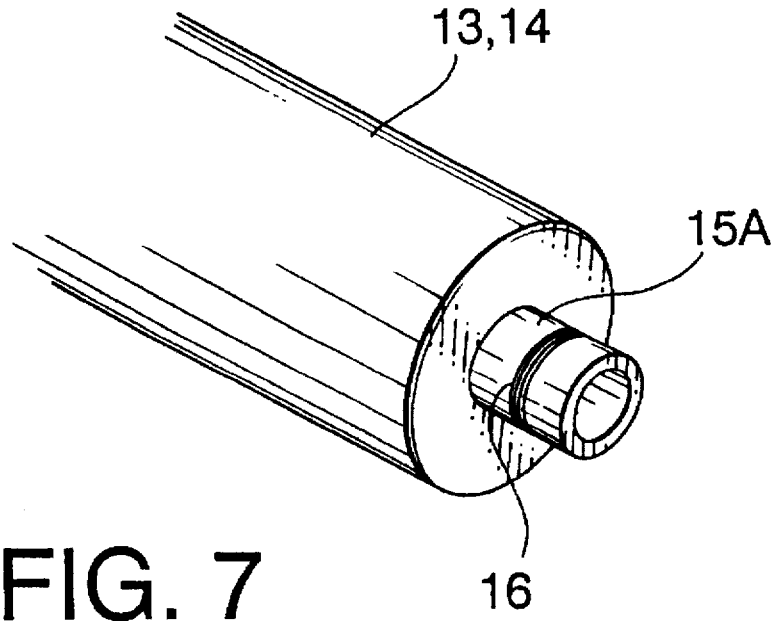
FIG. 7 is a perspective view of identification mark attached to the ink ribbon.
Figure 8:
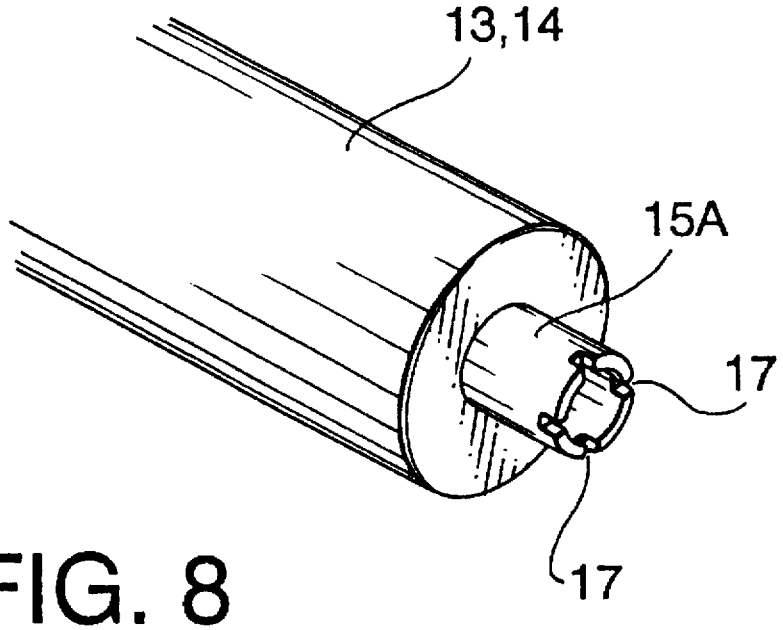
FIG. 8 is a perspective view of another identification mark formed in the ink ribbon.

Examples of the ink ribbon discrimination mark are shown in FIGS. 7 and 8, respectively. In FIG. 7, a discrimination mark (for example, black marker) is attached to the periphery of an extension 15A of the paper tube 15. The extension 15A protrudes from the ribbon package 13 (or the rolling package 14) in the lateral direction of the package. In this case, the recording apparatus may be provided with a photosensor (not shown) as the ribbon discrimination means (ribbon sensor 18 in FIG. 1), which may be located in the vicinity of the extension 15A. Referring to FIG. 8, several cutaway portions 17 are formed in the tip of the extension 15A. In this case, the recording apparatus may be provided with a contact switch (not shown) as the ribbon sensor 18 (FIG. 1). In either case, a signal from the ribbon sensor 18 is input to a main controller 1 (FIG. 1) to automatically find out the kind of the ribbon.

As described above, according to the first aspect of the present invention, when the single-pass ink ribbon (or the multi-pass ink ribbon) is set up, the ribbon sensor 18 detects the ribbon discrimination means 16 (or 17) to automatically find out which ribbon is now in use. By providing the recording apparatus with such a ribbon discrimination function, it becomes practical to use two kinds of ribbon in a single recording apparatus, not counting that the printing condition and the ribbon movement condition are determined manually or automatically.

Next, a recording apparatus according to the second aspect of the present invention will be explained. The following explanation is premised on the foregoing explanation about the first aspect of the present invention.

if the multi-pass ink ribbon of FIG. 6 is employed, the printing condition and the ribbon movement condition for the multi-pass ink ribbon should be adjusted from those used for the single-pass ink ribbon. Therefore, if two ink ribbons are set in the recording apparatus, it is necessary to provide control means for automatically controlling the printing condition and the ribbon movement condition in accordance with the kind of ribbon detected by the ribbon sensor 18.

FIG. 1 depicts an example of control means 10 incorporated in the recording apparatus. The recording apparatus is a type used for a facsimile machine having a thermal transfer recording function. In FIG. 1, numeral 1 designates a main controller (CPU) which performs an overall control of the communication with another facsimile machine. The main controller 1 serves as the control means of the present invention. The main controller 1 is connected with a telephone line L via a modem 2 and a NCU 3. The main controller 1 includes an appropriate number of ROMs 4 and RAMs 5, the aforementioned ribbon sensor 18, the aforementioned thermal head 12 and the aforementioned step motor 20. The ROMs 4 and RAMs 5 serve as a storage device, and the ribbon sensor 18, the thermal head 12 and the step motor 20 serve as an input device and an output device.

Figure 2:
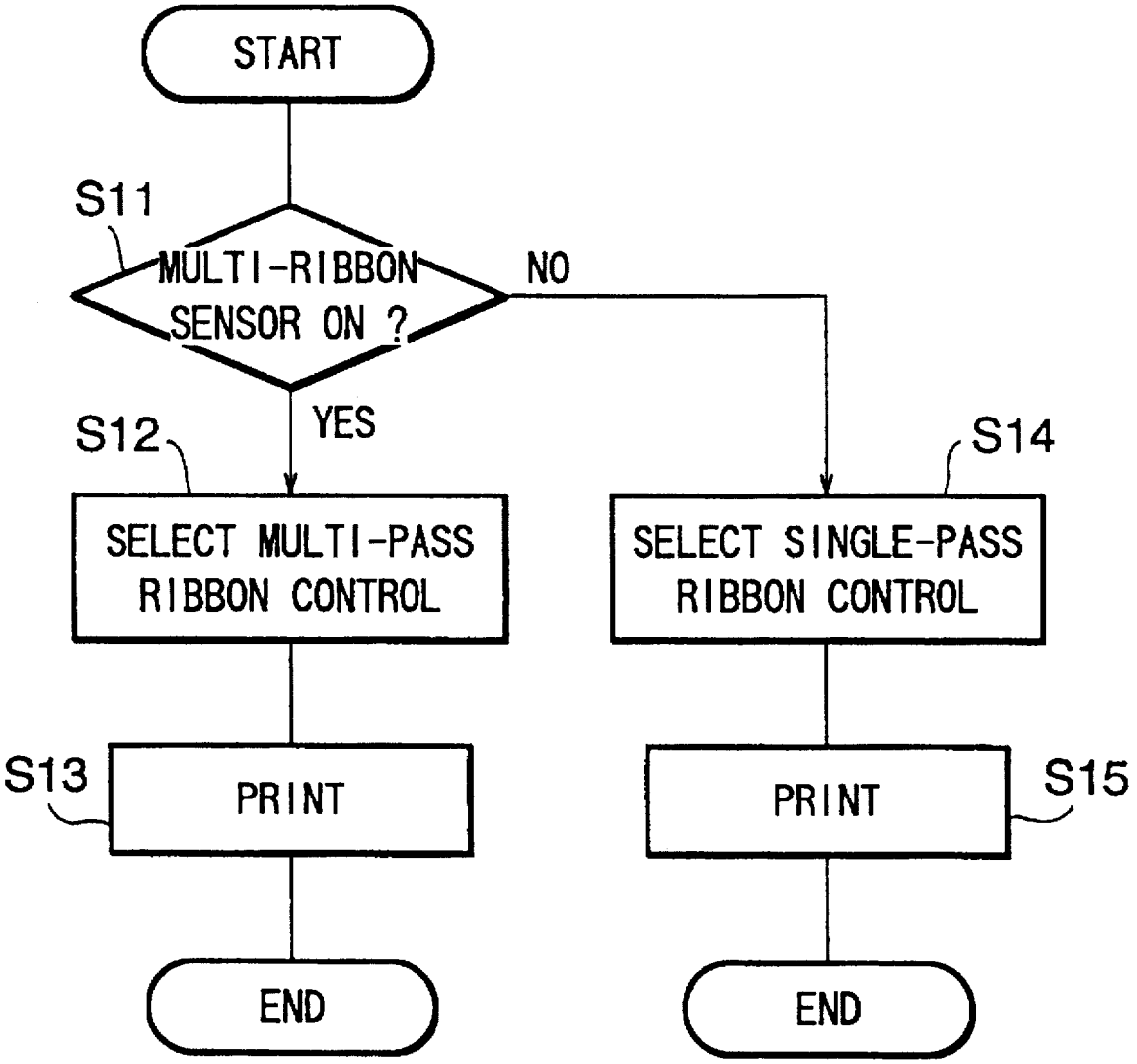
FIG. 2 is a flow chart of the general control applied to the embodiment of FIG. 1.

FIG. 2 illustrates a flow chart used by the main controller 1 in controlling the printing condition as well as the ribbon movement condition. As shown in the flow chart, the kind of the ribbon is detected based on the information input from ribbon sensor 18 (step 11). If the multi-ribbon sensor is in the on state, a control program for the multi-pass ribbon is selected so as to determine the printing condition and the ribbon movement condition suitable for the multi-pass ribbon (step 12), so as to perform a predetermined printing operation (step 13). Control programs for the respective kinds of the ribbon are stored in the ROM 4 beforehand. On the other hand, if the answer at step 11 is no, i.e., if the multi-ribbon sensor is in the off state or if the single-pass ink ribbon is detected, a control program for the single-pass ribbon is selected from those stored in the ROM 4 so as to determine the printing condition and the ribbon movement condition suited for the single-pass ink ribbon (step 14), thereby performing another predetermined printing step (step 15).

Figure 9:
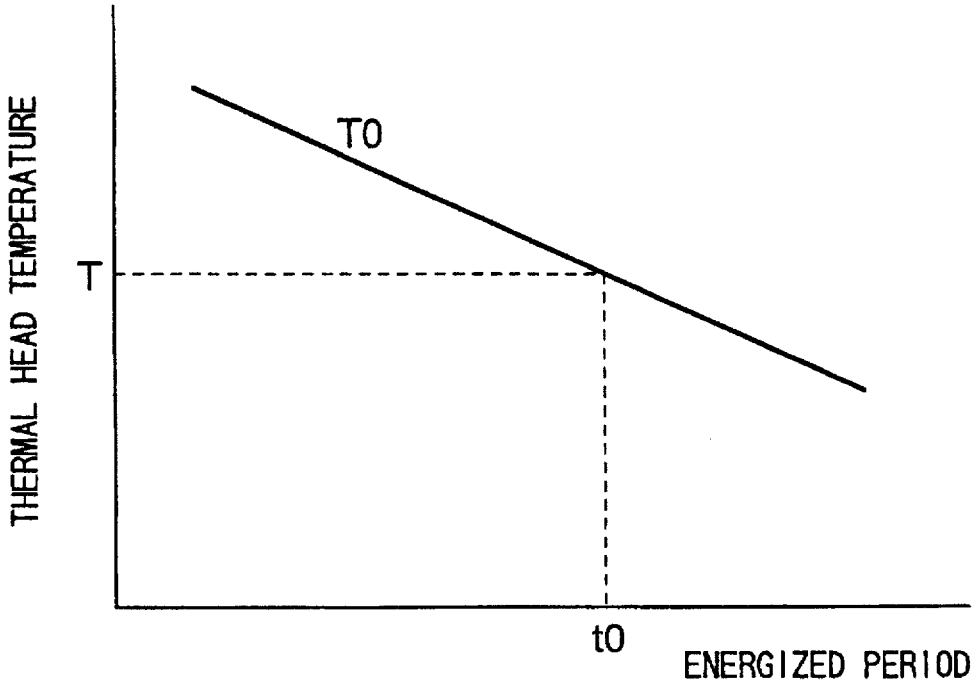
FIG. 9 schematically illustrates a temperature table T0 used for a single-pass ink ribbon with the horizontal axis indicating a thermal head energized period.
Figure 10:
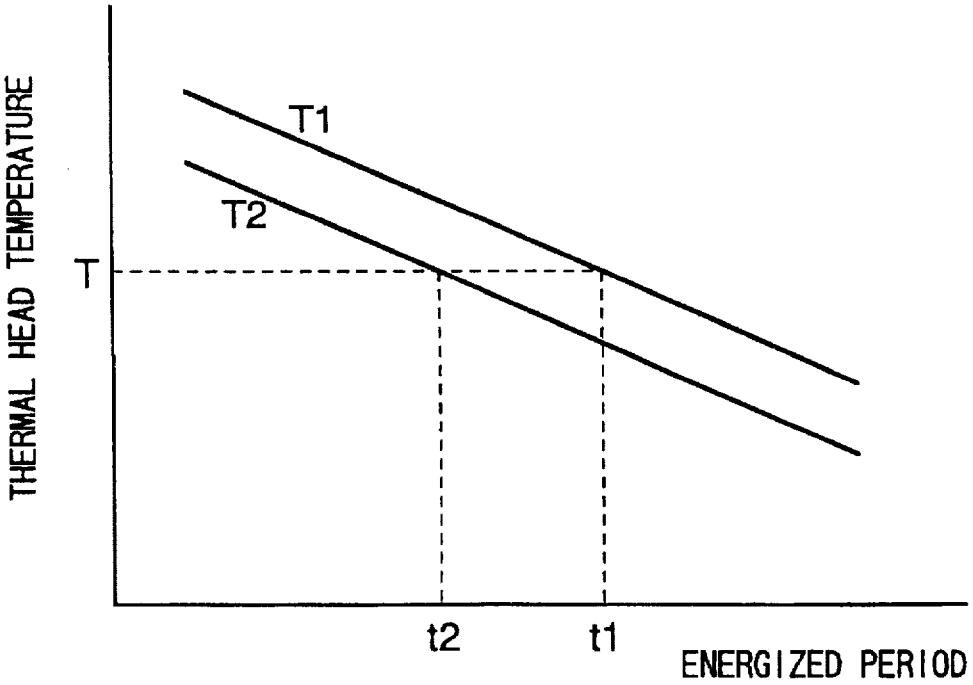
FIG. 10 schematically illustrates temperature tables T1 and T2 used for a multi-pass ink ribbon with the horizontal axis indicating a thermal head energized period.

The detail of the printing and ribbon movement conditions for the single-pass ink ribbon are the same as those known and established in the art. The printing density is adjusted with a temperature table T0 (linear line in FIG. 9) stored in the ROM 4, and the motor 20 1s only rotated in a normal direction in accordance with an image to be printed.

On the other hand, if the multi-pass ink ribbon is used, since the printing density at the first printing differs from that at the next printings and the same ribbon face should pass through the thermal head 12 several times back and forth, the time of printing of the ribbon face is counted based on the printing data accumulatively stored in the RAM 5 to individually and automatically determine the printing and ribbon movement conditions.

Figure 3:
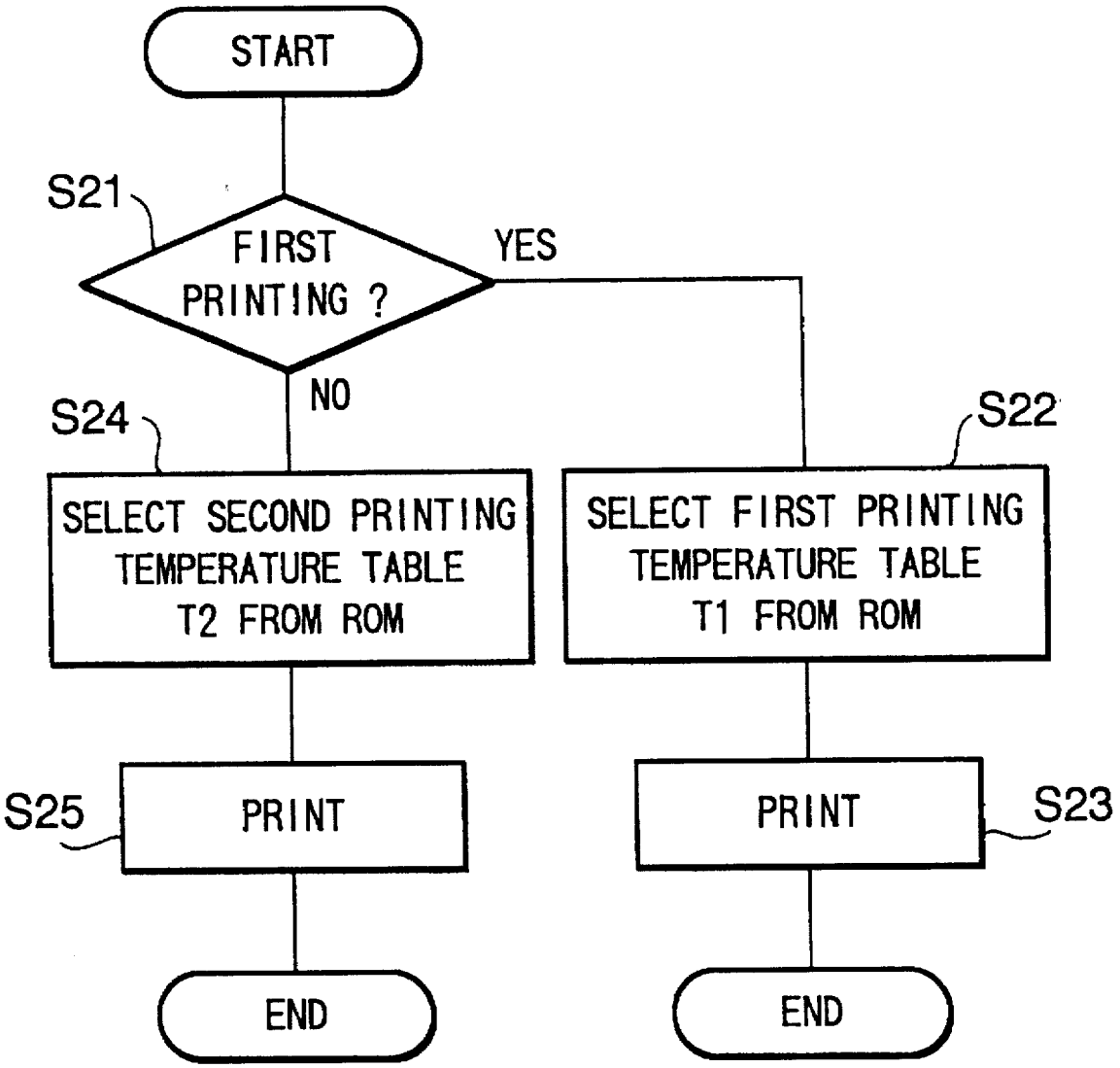
FIG. 3 is a flow chart of the printing control applied to the embodiment of FIG. 1.

FIG. 3 is a flow chart used for the printing operation executed by the main controller 1.

According to this flow chart, the time of the printing is counted based on the information of the ink ribbon location (step 21). This information is stored in a counter of the RAM 5. If it is found at step 21 that the present printing is the first printing, the program proceeds to step 22. At step 22, a temperature table T1, which 1s a table for the first printing, is selected among a number of temperature tables stored in the ROM 4 (see FIG. 12). The temperature tables are prepared for the respective times of the printing. The printing operation of the thermal head 12 is controlled under the thermal transfer condition determined in accordance with the selected temperature table T1 (step 23).

On the other hand, if it is found at step 21 that the current printing is the second printing, the program advances to step 24. At step 24, another temperature table T2 is selected from the group of temperature tables stored in the ROM 4 (see FIG. 12). The temperature table T2 is the one suited for the second printing. The printing movement of the thermal head 12 is controlled under the thermal transfer condition determined in accordance with the temperature table T2 (step 25).

In this manner, if the recording apparatus is provided with the print control means 10 of the present invention, the conditions of the thermal transfer are individually determined for the respective times of the printing in accordance with the temperature tables to maintain the printing density. Therefore, no difference appears in the printing density between the first printing and the second printing.

In the above, although the recording apparatus of the second aspect of the present invention has been described based on the recording apparatus of the first aspect, the recording apparatus of the next aspect of the present invention does not require all the components of the recording apparatus of the first aspect. For example, the ribbon sensor 18 is not indispensable to the third aspect of the present invention since only the multi-pass ink ribbon may be incorporated in the recording apparatus of the third aspect. However, the recording apparatus of the third aspect is substantially the same as that of the second aspect except for that the entire constitution of the first aspect is not the requisite. Accordingly, the detail of the third aspect will be omitted here.

According to the third aspect of the present invention, since the ribbon identification mark is attached or formed to discriminate the single-pass ink ribbon and the multi-pass ink ribbon from each other, the kind of the ribbon used for the printing is automatically detected by the ribbon discrimination means so that it is possible to use two kinds of ink ribbon in a single recording apparatus. In addition to the ribbon discrimination means, provided is the control means for automatically determining the printing condition and the movement condition of the detected ink ribbon. Therefore, what is realized by this aspect is a recording apparatus which can automatically determine appropriate printing and movement conditions for the respective ribbons.

Moreover, according to the third aspect of the present invention, the change of the printing density of the multi-pass ink ribbon, which occurs in the conventional apparatus as the printing operation is repeated, is prevented. Accordingly, the printing density is maintained until the ink ribbon is replaced by new one.

Next, a recording apparatus according to the fourth aspect of the present invention will be explained. The teaching of the fourth aspect makes it possible to prevent the printing density change during the repeated printing operations since the print control means 10 is provided for computing the added up black ratio of the ink ribbon and for selecting the most appropriate temperature table based on the added up black ratio to determine the printing condition of the thermal head 12.

Referring to FIG. 1, a group of temperature tables for the respective added up black ratios are stored in the ROM 4. It should be noted that the ribbon sensor 18 may not be provided in the recording apparatus according to the fourth aspect since only one kind of ink ribbon (multi-pass type) may be employed.

Figure 11:
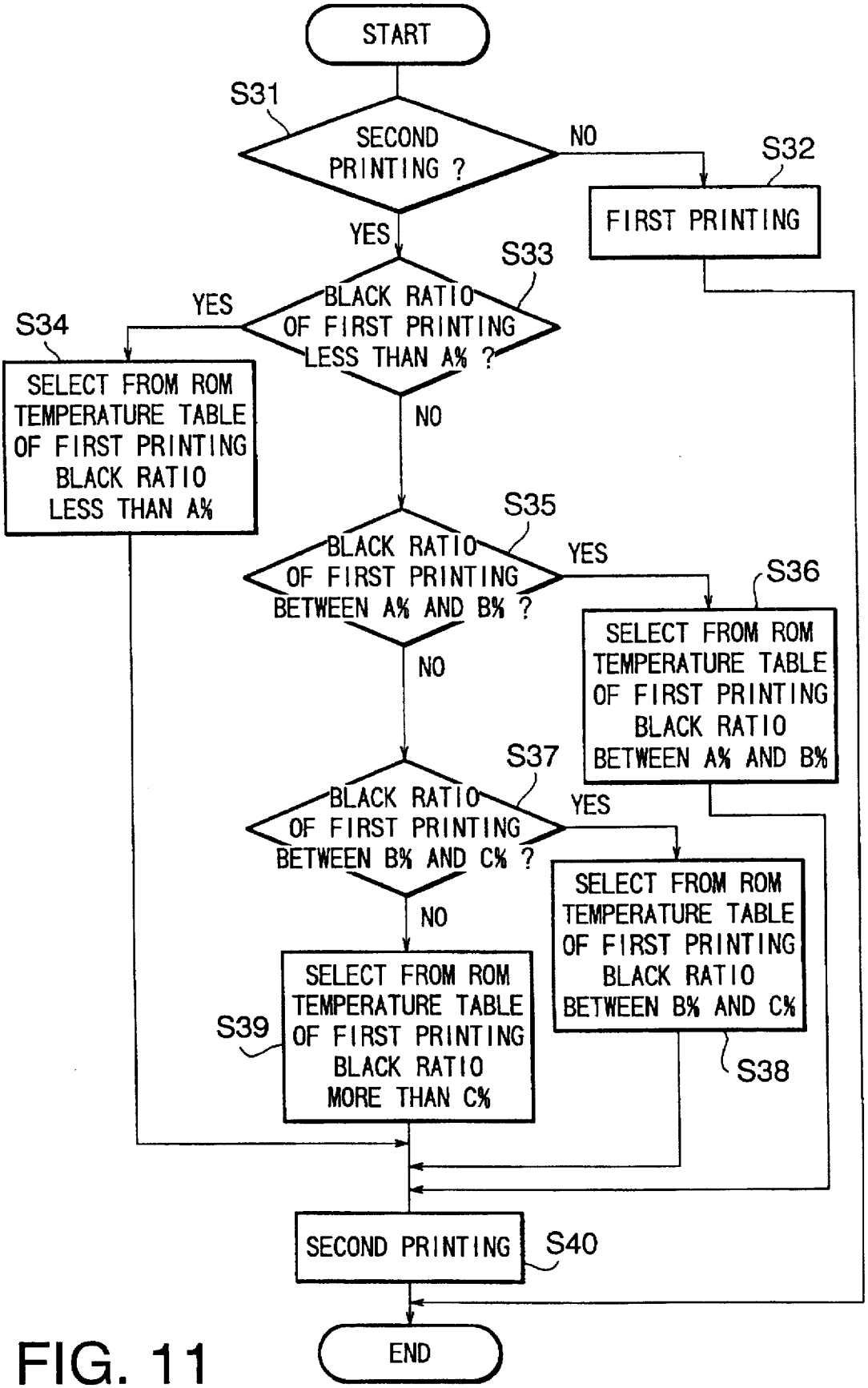
FIG. 11 is a flow chart of the control applied to another embodiment of the present invention.

FIG. 11 shows a flow chart used for the print control, which is executed by the main control unit 1. Here it should be noted that, for the sake of clarity, this flow chart is applied to the multi-pass ink ribbon R which can be used only twice.

According to the flow chart of FIG. 11, the time of the printing of the particular ribbon surface is detected on the movement and position information of the ink ribbon R (step 31). Such information is stored in the counter of the RAM 5. If the printing is the first printing, the program goes to step 32. Specifically, in case of the first printing, a temperature table T1 for the first printing is selected from the ROM 4 (see FIG. 12) and the thermal head 12 is controlled upon the printing condition determined by the temperature table T1.

On the other hand, if the printing is the second printing, the program goes to step 33. At step 33, the black ratio of the ink ribbon after the first printing is detected. The black ratio can be obtained easily. For example, it may be obtained by extracting data of a printed image (binary data) and calculating the ratio of "0" and "1".

Returning to the flow chart, it is checked at step 33 if the black ratio after the first printing is smaller than a first predetermined value A%. If the answer is yes, the program proceeds to step 34. At step 34, a temperature table T2A (see FIG. 12), used for the case of the black ratio being less than A%, is picked up from a number of temperature tables stored in the ROM 4. Then, the program proceeds to step 40 to cause the thermal head 12 to perform the second printing under the condition determined on the temperature table T2A.

If the answer at step 33 is no, then step 35 is executed. Specifically, it is now checked if the black ratio is between A% and B%. If the black ratio is within this range, the program advances to step 36 to select another temperature table T2B (see FIG. 12) which is suitable for a black ratio between A% and B%. After that, the second printing is performed (step 40).

If the black ratio is judged to be more than B% at step 35, the program advances to step 37 to check if the black ratio is between B% and C%. If the black ratio is within this range, the program advances to step 38 to select a temperature table T2C (see FIG. 12) appropriate for such a case. Then, the second printing is performed (step 40).

if the black ratio is judged to be more than C% at step 37, the program advances to step 39. At step 39, a temperature table T2X (see FIG. 12) used for the case of the black ratio being more than C% is selected and the program advances to step 40 to carry out the second printing operation. In this embodiment, therefore, one of the four temperature tables is chosen depending on the black ratio after the first printing.

In this manner, if the print control means 10 is provided, the black ratio of the ink ribbon after the first printing is detected, and the most appropriate temperature table (T2A, T2B, T2C or T2X) is selected based on the range (<A, A–B, B–C or >C) in which the black ratio falls, to keep the printing density unchanged. As a result, the printing density at the second printing is maintained the same as that at the first printing, regardless of the value of the black ratio.

Figure 12:
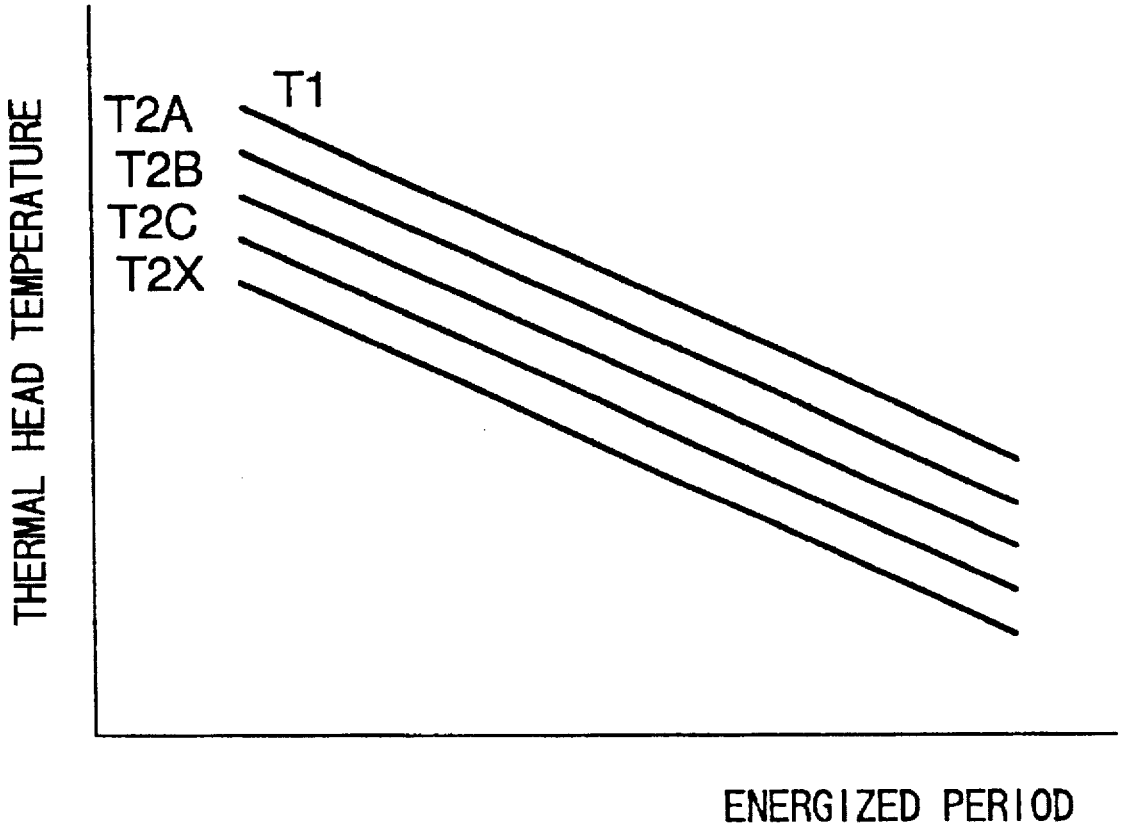
FIG. 12 is a graph schematically depicting temperature tables stored in a ROM with a printing black ratio being used as a parameter and the horizontal axis indicating a thermal head energized period.

Here it should be noted that the size of the ranges can be arbitrarily determined and the number of the temperature tables as well. In other words, those illustrated in FIG. 12 are mere examples for the sake of clarity in explaining the individual selection of the temperature table, and another pattern of temperature tables may be employed in an actual case.

The above embodiment deals with the simplest multi-pass ink ribbon, i.e., the one which can be used only twice. However, the present invention can be applied to the multi-pass ink ribbon which can be used three times or more. In this case, the black ratio is added up upon each printing operation to obtain the added up black ratio, and the added up black ratio is used in selecting the temperature table for the next printing. If the printing is performed three times or more in accordance with the teaching of the fourth aspect of the present invention, an excessive consumption of the ink after the second printing is prevented. Consequently, the printing error and the quality deterioration are prevented, and the longevity of the ink ribbon can be maximized.

As described above, according to the fourth aspect of the present invention, even if the multi-pass ink ribbon is used, the printing density fluctuation does not occur after the first printing due to the changing added up black ratio, and the automatic printing density control is provided. Further, the excessive consumption of the ink after the first printing is also prevented. As a result, the ink ribbon used in the recording apparatus of the present invention lasts longer than that used in the conventional apparatus.

Next, a recording apparatus according to the fifth aspect of the present invention will be explained. When the multi-pass ink ribbon is used, the teaching according to the fifth aspect enables an automatic multi-pass operation of the ink ribbon R through the thermal head 12. This is made possible since the ribbon movement control means 10 is provided for pulling back the ink ribbon R to the starting position of the first printing. Here it should be noted that the ribbon sensor 18 of FIG. 1 is not indispensable to the recording apparatus of the fifth aspect.

Figure 4:
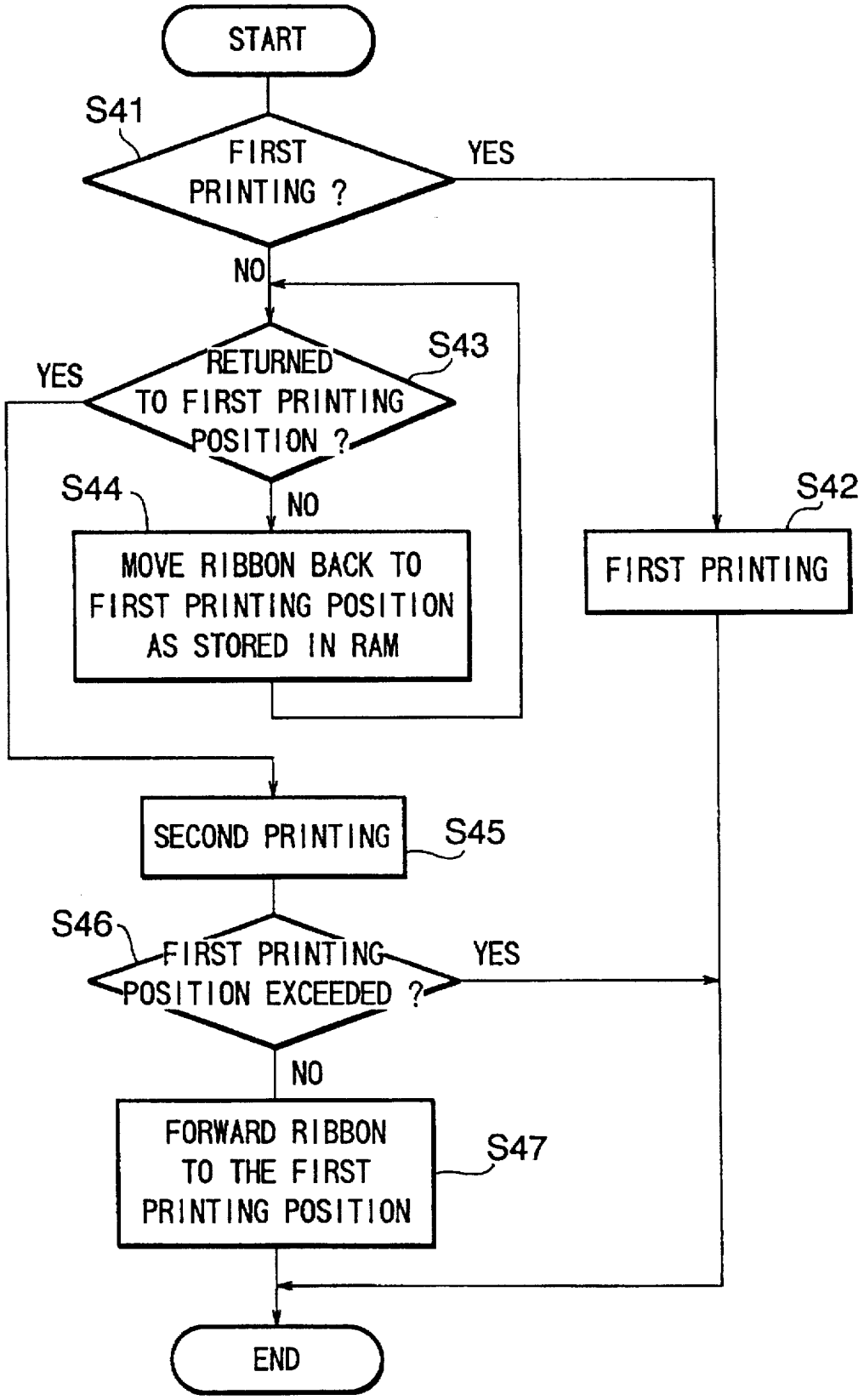
FIG. 4 is a flow chart of the ribbon movement control applied to the embodiment of FIG. 1.

Referring now to FIG. 4, depicted is a flow chart used for the ribbon movement control carried out by the main controller 1. For the sake of simplicity, employed in this embodiment is the multi-pass ink ribbon R which can be used only twice.

According to the flow chart, the time of the printing which the ink ribbon has experienced is detected based on the information of the ink ribbon movement stored in the counter of the RAM 5 (step 41). If it is found at step 41 that the present printing is the first printing, the program goes to step 42 to start the first printing operation.

On the other hand, if the present printing is judged to be the second printing at step 41, it is checked if the ink ribbon R has returned to the starting position of the first printing (step 43). If the ink ribbon R is not at the starting position, the step motor 20 is rotated in the reverse direction to pull back the ink ribbon R to the starting position (step 44). The step motor 20 is reversely rotated by the number of pulses of the step motor 20 which is counted by the counter of the RAM 5 (Pulses of the step motor 20 is counted from the beginning to the ending of the first printing). The printing operation is referred to as "first printing" until the same ink ribbon surface is used again. This pulling back operation may be performed when the printing on one entire recording sheet P is finished or when the data transmission from a certain party is completely finished.

Returning to the flow chart of FIG. 4, upon the confirmation of the ink ribbon R being positioned at the starting position, the program goes to step 45 to perform the second printing. Before the second printing, an appropriate temperature table is selected from a number of temperature tables stored in the ROM 4 so that the second printing will be performed under a different condition, compared with the first printing, to maintain the printing density. After the second printing, it is checked whether the length of the second printing is larger than that of the first printing (step 46). If the former exceeds the latter, the program proceeds to END.

On the other hand, if the answer at step 46 is no, the step motor 20 is rotated in the normal direction a number of pulses, which corresponds to the difference in length between the first printing and the second printing, so as to move the ink ribbon R to the end position of the first printing (step 47). After step 47, the program proceeds to END. The next printing starts from a virgin area of the ink ribbon. Therefore, it is possible to prevent the same surface of the ink ribbon R from being used for the printing more than twice. If the economic use of the ribbon R is the only object, the aforementioned ribbon pulling back operation may be omitted, and alternatively the area of the ink ribbon used for the printing may be successively detected during the first printing and the same area may be used again during the second printing.

If the first and second printing operations follow the control supervised by the ribbon movement control means 10, the second printing starts from the position from which the first printing has started, and the same area of the ink ribbon used for the first printing is used again for the second printing. After that, a non-used area of the ink ribbon is used for the printing twice. Accordingly, when the ink ribbon R is entirely rolled into the rolling package 14, substantially all the surface of the multi-pass ink ribbon R will have been used for the printing.

Therefore, the ink ribbon R is used very economically and the frequent replacement of the ink ribbon R is not necessary. Further, although the conventional apparatus requires an operator to change the positions of the rolling package and the unrolling package, the present invention eliminates such a necessity. In addition, the operator does not have to pay attention to how many times the ink ribbon is used.

In the above explanation, the simplest multi-pass ink ribbon which can be used only twice is employed although it is of course possible to apply the teaching according to the fifth aspect of the present invention to other types of multi-pass ink ribbon.

As described above, according to the fifth aspect of the present invention, a troublesome hand work such as exchanging the rolling and unrolling packages is unnecessary and paying attention to how many times the ink ribbon is used is no longer required.

The foregoing explanation is made to the facsimile machine. However, the teaching of the present invention can be applied to a common type of thermal transfer-type ink ribbon recording apparatus.

We claim:

1. An ink ribbon recording apparatus for use with a multi-pass thermal ink ribbon, the multi-pass ink ribbon having an ink layer having a thickness that is greater than that of an ink layer of a single-pass ink ribbon, the multi-pass thermal ink ribbon defining a length, a width, a lengthwise direction and a widthwise position, the apparatus comprising:

thermal print head means for performing a plurality of thermal printing operations using the multi-pass thermal ink ribbon, means for detecting a position of the multi-pass thermal ink ribbon; and means for pulling back the multi-pass thermal ink ribbon in the lengthwise direction, upon the completion of at least one printing operation during a plurality of printing operations, to a position from which at least one printing operation started, prior to a next printing operation while substantially simultaneously maintaining the widthwise position of the ink ribbon constant.

2. The recording apparatus of claim 1, further including control means for determining a printing condition and a ribbon movement condition based on the kind of ribbon.

3. The recording apparatus of claim 2, further including:

means for selecting one of the ink ribbons to be used for the printing operation;

a first roller for feeding the selected ink ribbon;

a second roller for rolling the selected ink ribbon;

a thermal head for thermal transferring an ink of the selected ink ribbon onto a recording sheet; and means for rotating the first and second rollers respectively.

4. The recording apparatus of claim 3, wherein the multipass ink ribbon includes a base element, a wax applied on one surface of the base element, a first heat resisting layer laid over the other surface of the base element and a second heat resisting layer laid over the wax such that the second heat resisting layer is used for the first printing operation and the wax is used for the next printing operations.

5. The recording apparatus of claim 4, wherein a marker is attached to one end of the roller and the ink ribbon discrimination means includes a sensor for detecting the marker.

6. The recording apparatus of claim 4, wherein a cutaway portion, formed in one end of the roller and the ink ribbon discrimination means, includes a sensor for detecting the cutaway portion.

7. The recording apparatus of claim 4, further including means for detecting the temperature of the thermal head, and wherein the control means includes a plurality of temperature tables such that the control means determines the printing and ribbon movement conditions using a temperature table selected in accordance with the detected temperature of the thermal head.

8. The recording apparatus of claim 5, further including means for counting how many times the ink ribbon is used for the printing operation, and wherein the control means determines the printing and ribbon movement conditions using the counted time in addition to the temperature of the thermal head.

9. The recording apparatus of claim 2, wherein the control means determines the printing condition such that the printing density is maintained as long as the same ink ribbon is used.

10. The recording apparatus of claim 1, wherein the ink ribbon pulling back means includes a motor for reversely rotating the ink ribbon and a controller for driving the motor.

11. The recording apparatus of claim 10, wherein the controller includes a counter for counting a number of pulses of the motor and the motor is reversely rotated the pulse number counted by the counter.

12. The recording apparatus of claim 11, wherein the motor can further rotate the ink ribbon in a normal direction so that if the ink ribbon does not reach or exceed the ending position of the first printing operation, the controller causes the motor to rotate the ink ribbon normally to advance the ink ribbon to the first printing ending position.

* * * * *